US010735885B1

(12) United States Patent
Blewett et al.

(10) Patent No.: US 10,735,885 B1
(45) Date of Patent: Aug. 4, 2020

(54) MANAGING IMAGE AUDIO SOURCES IN A VIRTUAL ACOUSTIC ENVIRONMENT

(71) Applicant: Bose Corporation, Framingham, MA (US)

(72) Inventors: Mark Blewett, Framingham, MA (US); Janet Xu, Framingham, MA (US); Stoyan Iliev, Framingham, MA (US); Wade Torres, Framingham, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 16/599,338

(22) Filed: Oct. 11, 2019

(51) Int. Cl.
*H04R 3/00* (2006.01)
*H04R 5/00* (2006.01)
(Continued)

(52) U.S. Cl.
CPC ..... *H04S 7/304* (2013.01); *H04R 5/033* (2013.01); *H04R 5/04* (2013.01); *H04S 2400/11* (2013.01); *H04S 2420/01* (2013.01)

(58) Field of Classification Search
CPC ... H04R 3/00; H04R 3/05; H04R 3/12; H04R 1/008; H04R 1/028; H04R 1/10; H04R 1/40; H04R 1/406; H04R 5/00; H04R 5/02; H04R 5/04; H04R 5/027; H04R 5/033; H04S 7/00; H04S 7/302; H04S 7/303; H04S 7/304; H04S 7/305; H04S 7/306; H04S 7/40; H04S 3/00; H04S 3/008;
(Continued)

(56) References Cited

U.S. PATENT DOCUMENTS 6,801,627 B1 * 10/2004 Kobayashi ..... H04S 1/005 381/17
8,005,228 B2 8/2011 Bharitkar et al.
(Continued)

FOREIGN PATENT DOCUMENTS

EP 3046341 A1 7/2016

OTHER PUBLICATIONS

Shinn-Cunningham, Localizing Sound in Rooms, Proceedings of the ACM SIGGRAPH and EUROGRAPHICS Campfire: Acoustic Rendering for Virtual Environments, Snowbird, Utah, May 26-29, 2001, 17-22.
(Continued)

*Primary Examiner* — Thang V Tran
(74) *Attorney, Agent, or Firm* — Young Basile Hanlon & MacFarlane, P.C.

(57) ABSTRACT

Providing a virtual acoustic environment comprises determining updates to audio signals based at least in part on information in sensor output, including, for each of multiple time intervals: determining an updated position of a wearable audio device, based at least in part on position information in the sensor output; determining layouts of at least four virtual walls, where the layouts are determined such that the updated position is within a space defined by the virtual walls; determining positions of at least four image audio sources associated with a virtual audio source, where a position of each image audio source is dependent on a layout of a corresponding one of the virtual walls and a position of the virtual audio source; and processing the audio signals using an update determined based at least in part on the respective positions of the virtual audio source and the image audio sources.

29 Claims, 3 Drawing Sheets

(51) Int. Cl.
*H04S 7/00* (2006.01)
*H04R 5/04* (2006.01)
*H04R 5/033* (2006.01)

(58) Field of Classification Search
CPC ..... H04S 2420/01; G06F 3/01; G06F 3/011; G06F 3/16; G06F 3/165
See application file for complete search history.

(56) References Cited

U.S. PATENT DOCUMENTS 8,627,213 B1 1/2014 Jouppi et al.
9,508,335 B2 * 11/2016 Benattar ..... G10K 11/175
9,832,588 B1 11/2017 Norris et al.
9,955,280 B2 * 4/2018 Jarvinen ..... H04S 7/301
10,154,361 B2 * 12/2018 Tammi ..... H04R 3/005
2002/0025054 A1 * 2/2002 Yamada ..... H04S 7/304 381/310
2002/0164037 A1 * 11/2002 Sekine ..... H04S 7/304 381/18
2004/0013278 A1 * 1/2004 Yamada ..... H04S 7/304 381/309
2010/0034404 A1 * 2/2010 Dent ..... H04R 5/02 381/310
2010/0053210 A1 * 3/2010 Kon ..... H04S 1/002 345/620
2018/0262858 A1 * 9/2018 Noh ..... H04S 7/304
2018/0359294 A1 * 12/2018 Brown ..... H04L 65/403
2019/0289418 A1 * 9/2019 Jang ..... H04S 7/303
2019/0313201 A1 10/2019 Torres et al.
2020/0037091 A1 * 1/2020 Jeon ..... G10L 19/008

OTHER PUBLICATIONS

Zotkin et al., Rendering Localized Spatial Audio in a Virtual Auditory Space, IEEE Transactions on Multimedia, vol. 6, No. 4, Aug. 2004, 553-564.
Rakerd et al., Localization of sound in rooms, II: The effects of a single reflecting surface, J. Acoust. Soc. Am. 78(2), Aug. 1985, 524-533.

* cited by examiner

MANAGING IMAGE AUDIO SOURCES IN A VIRTUAL ACOUSTIC ENVIRONMENT

TECHNICAL FIELD

This disclosure relates to managing image audio sources in a virtual acoustic environment.

BACKGROUND

A virtual acoustic environment may be one in which a user of a wearable audio device hears sound that has been processed or "rendered" to incorporate auditory cues that give the user the impression of being at a particular location or orientation with respect to one or more virtual audio sources. For example, a head related transfer function (HRTF) can be used to model the effects of diffraction and absorption of acoustic waves by anatomical features such as the user's head and ears. Additionally, in some virtual acoustic environments, additional auditory cues that contribute to externalization and distance perception incorporate the effects of reflections within a simulated auditory space.

SUMMARY

In one aspect, in general, an audio system comprises: a first earpiece comprising a first acoustic driver and circuitry that provides a first audio signal to the first acoustic driver; a second earpiece comprising a second acoustic driver and circuitry that provides a second audio signal to the second acoustic driver; a sensing system including at least one sensor, where the sensing system is configured to provide sensor output associated with a position of a wearable audio device; and a processing device configured to receive the sensor output and to determine updates to the first audio signal and the second audio signal based at least in part on information in the sensor output. Determining the updates comprises, for each of multiple time intervals: determining an updated position of the wearable audio device, with respect to a coordinate system that has two or more dimensions, based at least in part on position information in the sensor output; determining layouts of at least four virtual walls with respect to the coordinate system, where the layouts are determined such that the updated position is within a space defined by the virtual walls; determining positions, with respect to the coordinate system, of at least four image audio sources associated with a virtual audio source, where a position of each image audio source is dependent on a layout of a corresponding one of the virtual walls and a position of the virtual audio source; and processing the first audio signal and the second audio signal using an update determined based at least in part on the respective positions of the virtual audio source and the image audio sources.

In another aspect, in general a method of providing a virtual acoustic environment comprises: providing a first audio signal to a first acoustic driver of a first earpiece; providing a second audio signal to a second acoustic driver of a second earpiece; providing sensor output from a sensing system that includes at least one sensor, where the sensor output is associated with a position of a wearable audio device; receiving the sensor output at a processing device; and determining, using the processing device, updates to the first audio signal and the second audio signal based at least in part on information in the sensor output. Determining the updates comprises, for each of multiple time intervals: determining an updated position of the wearable audio device, with respect to a coordinate system that has two or more dimensions, based at least in part on position information in the sensor output; determining layouts of at least four virtual walls with respect to the coordinate system, where the layouts are determined such that the updated position is within a space defined by the virtual walls; determining positions, with respect to the coordinate system, of at least four image audio sources associated with a virtual audio source, where a position of each image audio source is dependent on a layout of a corresponding one of the virtual walls and a position of the virtual audio source; and processing the first audio signal and the second audio signal using an update determined based at least in part on the respective positions of the virtual audio source and the image audio sources.

Aspects can include one or more of the following features.

The layouts are determined such that a layout of at least a first virtual wall is changed with respect to a layout of the first virtual wall in a previous time interval to enable the updated position to be within the space defined by the virtual walls.

The layout of the first virtual wall is changed to increase the space defined by the virtual walls.

The layout of the first virtual wall is changed based on the updated position being outside a previous space defined by the virtual walls before the layout of the first virtual wall was changed.

The layout of the first virtual wall is changed based on a range between the updated position and a location on a physical wall measured by at least one range finding sensor in the sensing system.

The layouts of all of the virtual walls are changed with respect to layouts of the virtual walls in the previous time interval.

The layouts of all of the virtual walls are changed to rotate the space defined by the virtual walls to enable the updated position to be within the space defined by the virtual walls.

The layouts of all of the virtual walls are changed based on a plurality of ranges between respective positions of the wearable audio device and respective locations on one or more physical walls measured by at least one range finding sensor in the sensing system.

The previous time interval comprises an initial time interval in which the layouts of each of the four virtual wall is determined by a default configuration of a virtual room that is large enough that an initial position of the virtual audio source and an initial position of the wearable audio device are within a space defined by the virtual walls.

The default configuration of the virtual room is large enough that initial positions of each of a plurality of virtual audio sources are within a space defined by the virtual walls.

Determining the updates further comprises, for each of the multiple time intervals, determining an updated orientation of the wearable audio device, with respect to the coordinate system, based at least in part on angle information in the sensor output.

The update used to process the first audio signal and the second audio signal comprises updated filters applied to the first and second audio signals that incorporate acoustic diffraction effects represented by a head-related transfer function that is based at least in part on: the respective positions of the virtual audio source and the image audio sources, and the updated orientation.

The angle information in the sensor output is provided by an orientation sensor that is rigidly coupled to at least one of the first or second earpiece.

The layouts are determined such that a predetermined threshold distance around the updated position is within the space defined by the virtual walls.

The coordinate system is a two-dimensional coordinate system, and the layouts of the virtual walls comprise line segments within the two-dimensional coordinate system.

The coordinate system is a three-dimensional coordinate system, determining the layouts includes determining layouts of a virtual ceiling and a virtual floor with respect to the three-dimensional coordinate system, and the layouts of the virtual ceiling, the virtual floor, and the virtual walls comprise rectangles within the three-dimensional coordinate system.

The layout of the virtual ceiling is determined such that the updated position is below the virtual ceiling, and the layout of the virtual floor is determined such that the updated position is above the virtual floor.

Determining the positions further comprises determining a position, with respect to the three-dimensional coordinate system, of: (1) at least a fifth image audio source associated with the virtual audio source, where a position of the fifth image audio source is dependent on the layout of the virtual ceiling and the position of the virtual audio source, and (2) at least a sixth image audio source associated with the virtual audio source, where a position of the fifth image audio source is dependent on the layout of the virtual floor and the position of the virtual audio source.

Aspects can have one or more of the following advantages.

A virtual acoustic environment can be associated with a variety of virtual audio sources within a virtual room. A combination of various auditory cues can be used to render left and right audio signals provided to left and right earpieces of a wearable audio device to contribute to the user's ability to localize the virtual audio source(s) in that virtual room. In some cases, a user experiencing a virtual audio source may be in a real acoustic environment that would naturally have an effect on the sound from such a virtual audio source if that virtual audio source were a real audio source in the real acoustic environment. For example, modeling certain aspects of a room, such as first-order reflections from the walls of that room, contributes to successful externalization and localization of spatial audio corresponding to a virtual audio source that the user is supposed to perceive as being in that room. Left and right audio signals provided to the user can be rendered based on incorporating image audio sources that represent those first-order reflections from virtual walls simulating the effects of the real walls, as described in more detail below. So, in some cases, a virtual acoustic environment can simulate some of the effect of the user's real acoustic environment on a virtual audio source.

However, estimating an appropriate layout for the virtual walls for such a virtual acoustic environment is challenging in the absence of a priori knowledge of the geometry of the real acoustic environment of the user. But, even without any information about a real room in which a user is physically present, there may be significant benefit to the user's perception in rendering reflections for a generic virtual room having a default layout for the virtual walls, as long as the default wall locations enclose all sources and the user and none of the image audio sources are too close to the user. In particular, the image audio source providing reflected sound should be farther from the user, and therefore quieter and arriving later, than the virtual audio source providing direct sound. In some cases, even if a user is in an open space rather than a room, or is in a relatively large room, there may still be significant benefit to the user's ability to localize sound by simulating the generic virtual room. The techniques described herein are able to track the user's position (e.g., the position of the wearable audio device) to automatically adapt the layout of the virtual walls, and corresponding image source positions, as the user moves around. Whether the user is in a real room for which an approximately matching virtual room is being simulated, or an open space or larger room for which a smaller virtual room is being simulated, these techniques can adapt to user movement. For example, the layouts of the virtual walls can be adapted in real time so that a user does not get close enough to an image audio source to impair the user's localization of the direct sound and resulting spatial audio experience, as described in more detail below.

BRIEF DESCRIPTION OF THE DRAWINGS

The disclosure is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity.

DETAILED DESCRIPTION

Figure 1:
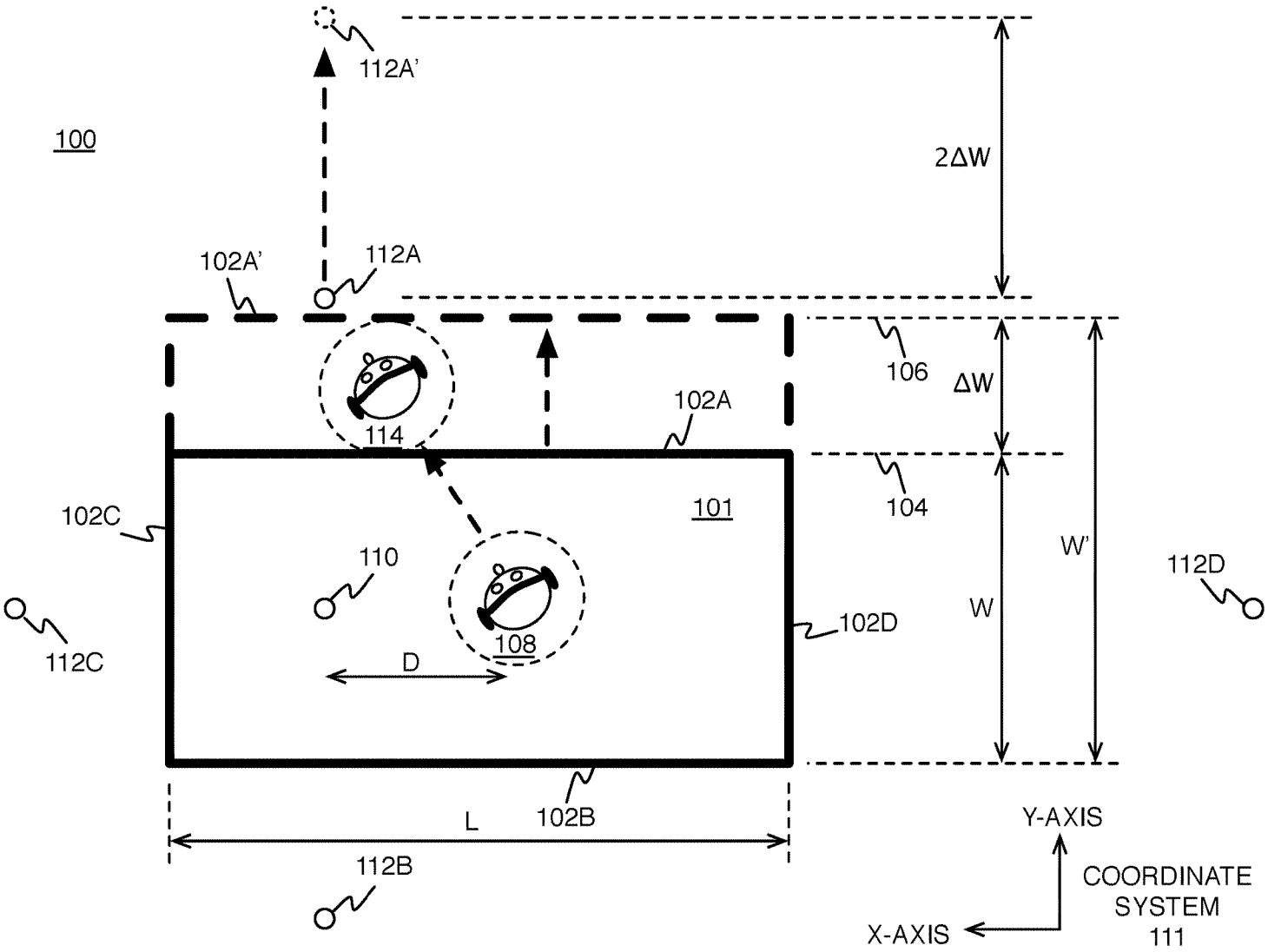
FIG. 1 is a schematic diagram of an example virtual acoustic environment.

When reproducing sound for a listener, monaural (or mono) sound reproduction provides the same audio signal to any number of sources, such as left and right earpieces of a wearable audio device. By contrast, stereophonic (or stereo) sound reproduction provides audio signals for left and right sources that provide certain aspects of a spatial audio experience in which some directionality may be perceived. Some audio systems provide two (or more) speakers placed within an environment to provide directionality, in which case the directionality is fixed with respect to that environment as a user moves. However, for a user hearing sound through left and right earpieces of a wearable audio device, that directionality is fixed with respect to a coordinate system that is tied to the user's head. So, if a user moves around, or tilts their head (or both) the reproduced sound moves and tilts with the user's head.

It is possible to render left and right audio signals of a wearable audio device such that the user perceives the sound as being fixed with respect to their physical environment, instead of their head. This rendering can take into account the position of the user (e.g., as sensed by a position sensor on the wearable audio device, or in proximity to the wearable audio device, such as on a phone or other device in the user's possession), and the orientation of the user's head (e.g., as sensed by an orientation sensor, which can be located on the wearable audio device, and can be implemented using an inertial measurement unit from which roll, pitch, and yaw angles can be derived). A head related transfer function (HRTF) can be used to model the effects of diffraction and absorption of acoustic waves by anatomical features such as the user's head and ears to provide appropriately rendered left and right audio signals. For example, low frequencies may diffract around a user's head providing differential delay, and high frequencies may be scattered or absorbed by different amounts. These effects, along with changes in magnitude that occur when ears point in different directions, provide directionality within three dimensions to localize sound. These effects can also achieve externalization, which enables a user to perceive sounds as originating from outside of their head instead of from inside their head. A given source audio signal associated with a virtual audio source can be processed with a left-ear HRTF corresponding to the appropriate angle of arrival to yield a left audio signal, and with a similarly corresponding right-ear HRTF to yield a right audio signal. Applications such as gaming, virtual reality, or augmented reality, may call for sound to be rendered to provide externalization and localization of spatial audio in three dimensions.

Another aspect of rendering sound to provide externalization and localization of spatial audio is providing the auditory cues that come from reflections from the hard surfaces of a room. In some implementations, significant perceptual benefit can be obtained by modeling just the first-order reflections, and in other implementations, further benefit can be obtained by also modeling additional (e.g., second-order reflections, or second-order and third-order) reflections. Rendering one or more virtual audio sources without such reflections would simulate those sources as they would be heard by the user if they were in a virtual anechoic chamber (where the walls, floor, and ceiling completely absorb all sound). Even with real audio sources in a real anechoic chamber, people tend to have more difficulty in localizing sounds (e.g., determining whether a source is in front of them or behind them) than in a room where sounds can reflect from the walls, floor, and ceiling. With reflections, a person's brain is able to interpret the acoustic effects from the resulting delayed signals along with the auditory cues associated with diffraction and absorption to better localize the direction from which the sound arrives at their ears, and the distance to the sources of those sounds.

In some cases, the user may actually be in a room of a certain size, and a virtual acoustic environment dynamically represents acoustic effects associated with virtual audio sources as the user moves around the actual room. While some information about the layout of the actual room may be incorporated into a layout for a virtual room, even if the virtual room is larger or smaller than the actual room or at the wrong angle with respect to the user, perceptual experiments have shown that a user's experience may still be enhanced. In other cases, the user is in an open environment (or in a much larger room), and a virtual acoustic environment dynamically represents acoustic effects associated with virtual audio sources as the user moves around a space that is supposed to be perceived as being a room (or a much smaller room). In that case, the room may simply be provided to enhance the user's ability to localize sounds. But, in any case, the layout of the virtual walls can be dynamically adapted based on the movement of the user to avoid impairment of the localization that could otherwise be caused if the user moved too close to an image audio source, as described in more detail below.

For simplicity, in the following example, these techniques will be described for a single virtual audio source, but they can be extended to apply to any audio scene, which defines any number of virtual audio sources that are arranged within a virtual acoustic environment. In some cases, the audio scene may also be dynamic with virtual audio sources being added or removed, or virtual audio sources being moved over time. At any given point in time, the techniques can be applied for any virtual audio sources that are within the audio scene at that time. Since the filters being used to render the left and right audio signals are generally linear, a sum of the individual signals generated for the individual sources corresponds to the signal that would be generated for a scene made up of the sum of the individual sources. Also, the following example will be described with respect to a two-dimensional coordinate system for the layouts of virtual walls (in X and Y coordinates), but similar explanations would apply for a three-dimensional coordinate system for the layouts of the virtual walls and for the layouts of a virtual ceiling and virtual floor (with a Z coordinate added). The following example will also model just the first-order reflections.

An audio processing system can be configured to process left and right audio signals to be streamed to the wearable audio device. The audio processing system can be integrated into the wearable audio device, or can be implemented within an associated device that is in communication with the wearable audio device (e.g., a smart phone), or within an audio system in a room in which the user is experiencing the audio reproduction of the virtual acoustic environment. Referring to FIG. 1, an example virtual acoustic environment 100 comprises a virtual room 101 that has initial default layouts for virtual walls 102A, 102B, 102C, and 102D. The techniques described herein are able to adapt the virtual room 100 from the default layouts, for example, with wall the 102A in a default location 104 being replaced by a wall 102A' in an adjusted location 106. Along with the change in location of the wall 102A, there is a change in size of the adjacent walls 102C and 102D, from a width W to a width W'. Thus, a change in "layout" of a virtual wall may include a change in a location and/or a change in size of that virtual wall. As a starting point, the default virtual wall layouts can be configured, for example, based on an initial distance D between an initial user position 108 and a virtual audio source position 110. The distance D can be selected by a designer of the audio scene. The audio scene can define coordinates of the default virtual wall layouts and the virtual audio source position 110, based on the initial user position 108, using variables in an associated coordinate system 111 defining X and Y axes. For example, a default layout for the virtual room can define a rectangular space within the coordinate system 111 that has a predetermined width W and length L, which may be dependent on the initial distance D (or the maximum of the initial distances if there are multiple virtual audio sources in an audio scene), or may be selected such that the size of the default room layout (e.g., the values of W and L) is large enough to accommodate any reasonable initial distance D.

To efficiently process the left and right audio signals, the audio processing system can be configured to use an image source technique in which positions for a number of image audio sources are determined. The image source technique can facilitate frequent updates over relatively short time intervals without requiring significant computation compared to other techniques (e.g., acoustic ray tracing techniques). For each virtual wall that is being modeled, an image audio source is generated with a position that is on the opposite side of the virtual wall from the virtual audio source. The distance between a given virtual wall and a given image audio source is equal to the distance between that virtual wall and the respective image audio source, along a line segment normal to the virtual wall.

So, referring again to FIG. 1, in this example, the image audio source position 112A corresponds to the distance between the virtual audio source position 110 and the wall 102A, the image audio source position 112B corresponds to the distance between the virtual audio source position 110 and the wall 102B, the image audio source position 112C corresponds to the distance between the virtual audio source position 110 and the wall 102C, and the image audio source position 112D corresponds to the distance between the virtual audio source position 110 and the wall 102D. As long as the user stays within the bounds of the default layout of the virtual room 100, the result of the image source technique is that the correct angles of wall reflections, and the correct attenuation as a function of distance, is achieved by the audio processing system mathematically combining different acoustic waves that would be propagating from the different audio sources driven by the same source audio signal (without any virtual walls present). Each simulated acoustic wave would also be processed using a different HRTF associated with different effects from arrival at the left ear or the right ear, producing a rendered left audio signal and a rendered right audio signal. These HRTFs would incorporate information about the orientation of the user's head from the sensor information.

Using a dynamic image source technique (instead of a static image source technique), the audio processing system can be configured to repeatedly update the computations using any updated sensor information that is received about the position and orientation of the user's head. So, if the user does not stay within the bounds of the default layout of the virtual room 100, the audio processing system is able to dynamically update the layout of the virtual room 100 to take into account that movement to avoid any impairments in the user's perception. As an example of such an impairment that could be experienced in a static image source technique (i.e., if the layout was not changed from the default layout), if the user were to move to a position 114 outside of the virtual room 100, at which the image audio source position 112A is closer to the user than the virtual audio source position 110, the sound from the image audio source position 112A would be louder and would arrive before the sound from the virtual audio source position 110. So, the user would perceive an audio source as being at the image audio source position 112A instead of at the virtual audio source position 110. This change of the perceived sound localization as the user crosses the virtual wall location can be avoided by adapting the layout of the virtual walls as a user approaches a given virtual wall. In this example, after the user moves to the position 114, the audio processing system determines updated virtual wall layouts (as shown by the dashed lines in FIG. 1), and the image audio source position 112A is adapted to an updated image audio source position 112A'. Thus, the sound localization is preserved within the new larger virtual room.

In some implementations, the change in the layout of a given virtual wall can be triggered in response to the sensed position of the user actually crossing that virtual wall. Alternatively, there can be a zone around the sensed position that is used to trigger a change in layout. In some implementations, a distance threshold around the sensed user position, illustrated by the dashed-line circles around the positions 108 and 114 in FIG. 1, can be set to take into account physical and/or perceptual factors. For example, physical factors can take into account a size of a typical person, or perceptual factors can take into account a distance between the user and the virtual wall at which localization impairments start to be perceived by some people. In some implementations, the distance threshold is set to a value between about 9-15 inches (e.g., based on an estimated distance between the center of the user's head to the end of a shoulder).

Similar processing can be performed for a third dimension for layouts of a virtual ceiling and virtual floor. Instead of the line segments shown in FIG. 1 for illustration purposes, the layouts of the virtual ceiling, the virtual floor, and the virtual walls would be rectangles within the 3D coordinate system. Also, instead of 4 image audio sources associated with a given virtual audio source, there would be 6 image audio sources associated with a given virtual audio source. Other aspects of the computations described herein associated with the virtual walls would also apply for the virtual ceiling and the virtual floor. In implementations in which additional, higher order, reflections are modeled, additional image audio sources can be included.

In some implementations, in addition to providing the capability of dynamically increasing the size of the virtual room, the audio processing system can be configured to rotate the virtual room so that it is more closely aligned to a real room with physical walls. For example, the wearable audio device may include a range finder used to determine distance between the range finder and different locations on at least one the physical walls over a sample of different directions. As the range finder is rotated and distances increase and decrease past the normal angle to a given physical wall, the angle of that physical wall within the coordinate system can be determined. The virtual walls can then be rotated to match the determined angle. The range finder can be implemented, for example, using a time-of-flight sensor. In some cases, the range finder can be used to estimate room geometries other than rectangular room geometries, even though certain portions of the room may be occluded and not within view of the range finder.

Figure 2:
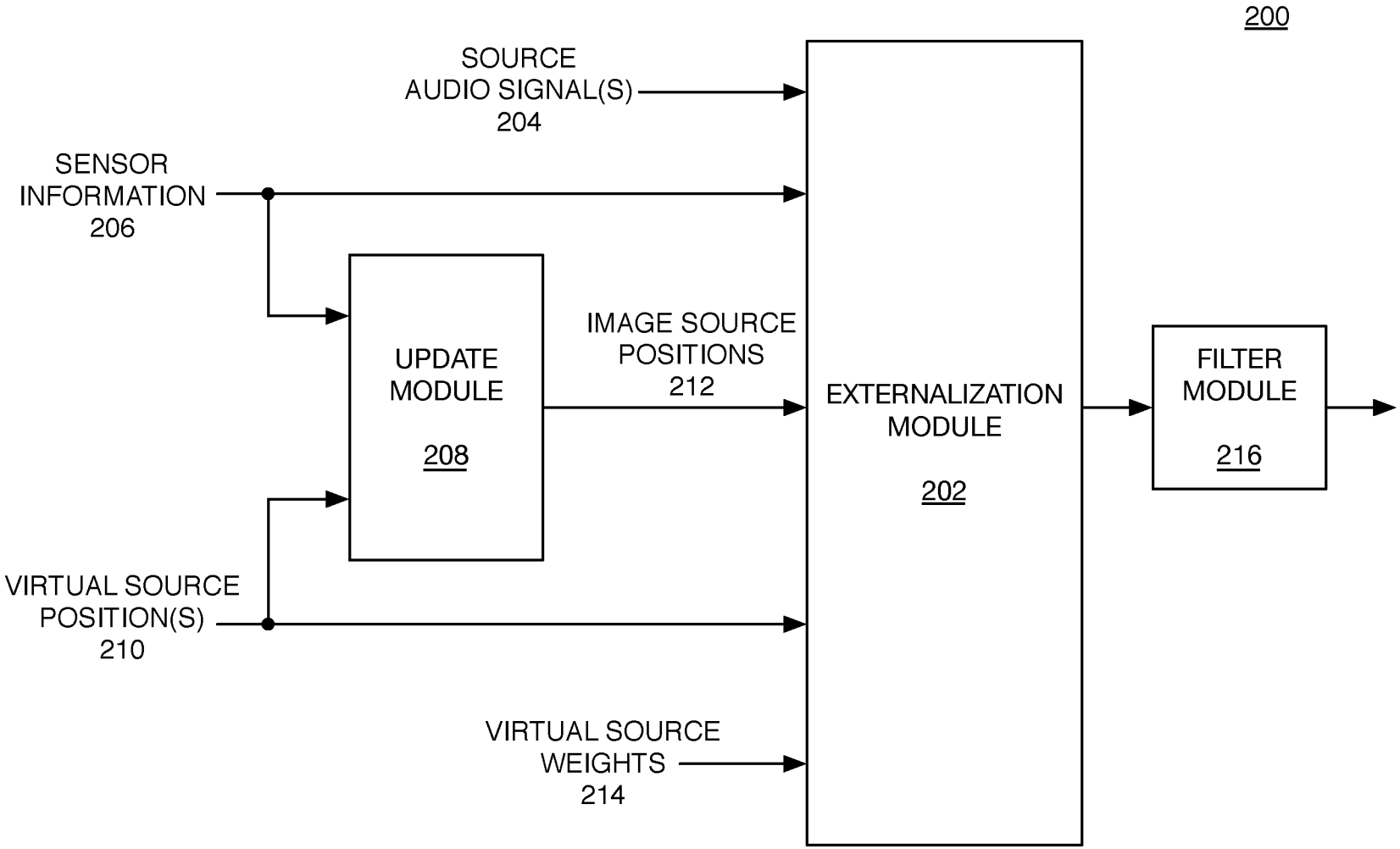
FIG. 2 is a block diagram of modules of an example audio processing system.

FIG. 2 shows a block diagram of an example arrangement of computation modules that can be implemented within circuitry of the audio processing system 200. An externalization module 202 includes a number of input ports (which may correspond to input variables, for example, in a software or firmware implementation). The externalization module 202 performs computations based on those inputs that yield filters representing effects of various audio cues that give the user the impression that sounds are arriving at their ears from outside their own head. Based on a relative angle and distance between the user's head and the virtual audio object, there are filters that incorporate HRTFs. Some of the filters apply effects of propagation delay due to distance between the user and the audio sources, and effects of frequency-dependent attenuation due to diffraction and propagation loss. A source audio signal(s) input 204 provides audio data (e.g., an audio file or audio stream) that corresponds to one or more virtual audio sources within an audio scene. The audio data for each virtual audio source may represent, for example, music from a speaker or musical instrument, or other sounds to be reproduced in the virtual acoustic environment. A sensor information input 206 provides sensor information from a sensing system that includes one or more sensors that acquire information about the user's position and the orientation of the user's head. The filters can then be combined (e.g., by applying them in series) to yield a final pair of filters for the left and right audio signals. These audio signals enable the user to perceive a virtual acoustic environment corresponding to a particular audio scene in a virtual room whose size dynamically adapts to the user's movement.

The sensor information input 206 is also provided to an update module 208. The update module 208 uses the sensor information input 206 and a virtual source position(s) input 210 to determine updated layouts for virtual walls, floor, and ceiling of the virtual room, which starts with default size and orientation relative to a coordinate system associated with the audio scene. The virtual source position(s) input 210 may include position information for any number of virtual audio sources. The update module 208 provides image source positions 212 to the externalization module 202 repeatedly over a series of consecutive time intervals (e.g., periodically at a predetermined update rate). The image source positions 212 correspond to positions of multiple image audio sources for each virtual audio source in the audio scene. For example, there will generally be six image audio sources for a virtual room that has a rectangular floorplan (one for each of four walls, one for the ceiling, and one for the floor). The image source positions 212 take into account virtual source position(s) input 210, and information about the user's position in the sensor information input 206. The virtual source position(s) input 210 is also provided to the externalization module 202, which allows the externalization module to compute appropriate filters for effects of diffraction and attenuation at each ear, for both the virtual acoustic source(s) and their corresponding image acoustic sources representing reflections within the virtual room.

Various other modules, and/or various other inputs or outputs of the described modules can be included in the audio processing system 200. In this example, another input to the externalization module 202 is a virtual source weights input 214 that provides information about a mix of different relative volumes of audio signals that may exist for a given audio scene, if there is more than one virtual audio source in the audio scene. There is also filter module 216 that receives the output of the externalization module 202 comprising left and right audio signals, and applies to them various types of equalization and/or other audio processing, such as overall volume control. In some implementations, the filter module 216 can include acoustic components and circuitry of an active noise reduction (ANR) system and/or a passive noise reduction (PNR) system. From the filter module 216, the signals can be transmitted to the wearable audio device. In some implementations, the inputs and outputs can be different and the functions performed by the different modules can be different. For example, instead of the externalization module 202 applying the computed filters directly to the signals, the externalization module 202 can provide the computed filters as an output (e.g., in the form of filter coefficients) to the filter module 216, which would apply the filters to the audio signals.

Figure 3:
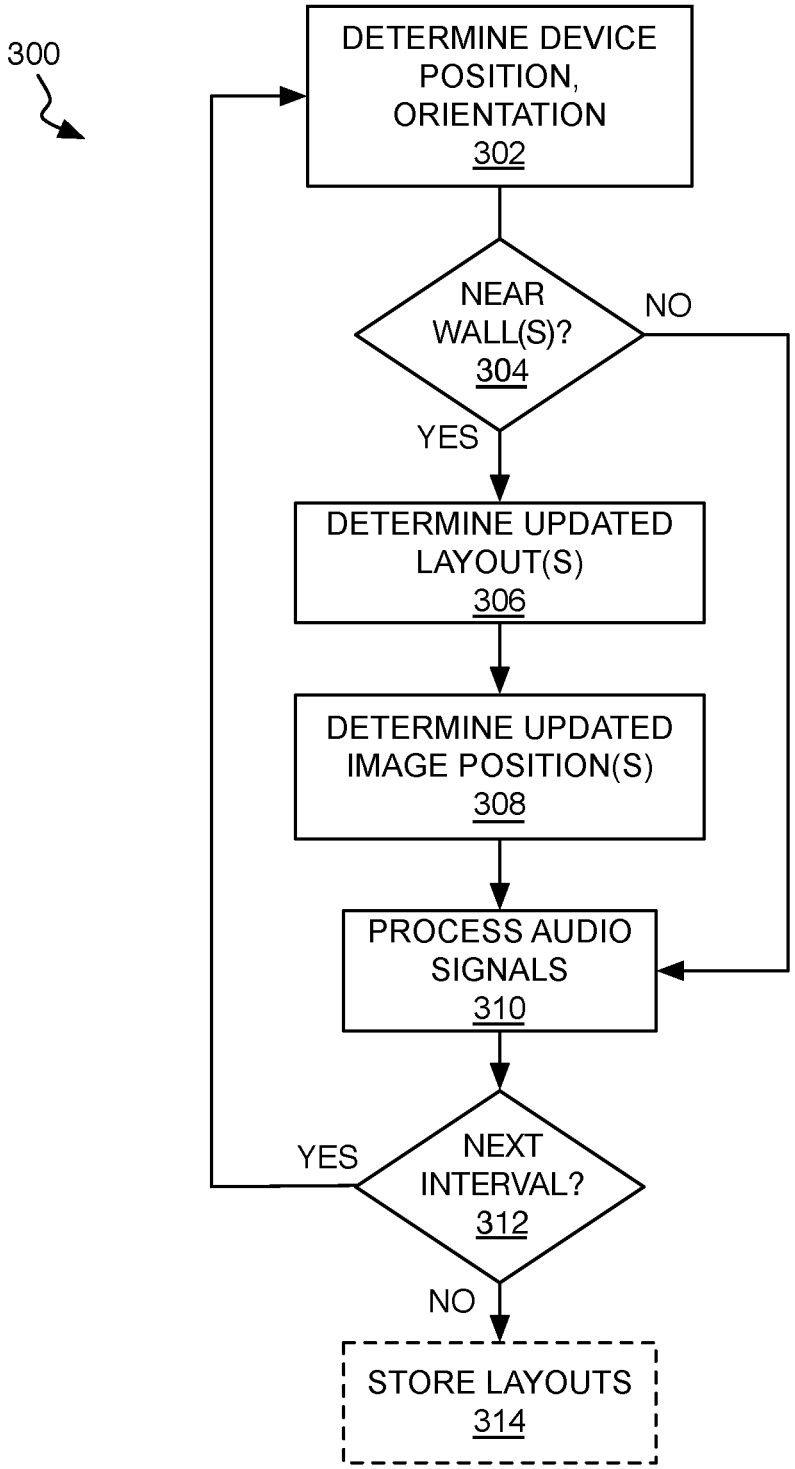
FIG. 3 is a flowchart for an example update procedure.

FIG. 3 shows a flowchart for an example procedure 300 that can be used by the update module 208 and externalization module 202 to provide audio signals based on updated positions 212 of image acoustic sources taking into account the position(s) 210 of the virtual audio source(s), and the user's (potentially changing) position. The procedure 300 performs a loop after some initialization is performed, which can include determining initial values for various inputs based on data corresponding to a programmed audio scene. In this example, the loop starts by determining (302) the position of the user (via the position of the wearable audio device or accompanying sensor, e.g., a sensor in a smart phone), based on position information in the sensor information input 206, which is provided as output by the sensing system. The procedure 300 determines (304) if the user is near the wall(s) based on the position of the user crossing one of the virtual walls, or being within a predetermined distance (possibly a zero distance) of one of the virtual walls (or of two virtual walls, if the user is near a corner of a room). If the user is near the wall(s), the procedure 300 determines (306) an updated layout for that virtual wall, and if necessary updated layouts for the virtual walls that end at that virtual wall. In the updated layouts, the virtual wall is moved out, and other walls are extended (in some cases implicitly) to end at the moved virtual wall. The updated virtual wall layouts are determined such that the user's position is within the larger increased space of the virtual room defined by the virtual walls. If the user is not near the wall(s) in this loop iteration, then the procedure 300 skips to processing (310) the left and right audio signals, as described below.

For a virtual wall that has been moved, the procedure 300 determines (308) positions, with respect to the coordinate system, of the image audio sources associated with each virtual audio source. A position of each image audio source is dependent on a layout of a corresponding one of the virtual walls and a position of the virtual audio source. As described above, the position of a first-order image audio source is along a normal line that extends from the virtual audio source through the corresponding virtual wall, and is at the same distance from the virtual wall as the virtual audio source. So, if a particular virtual wall moves by a distance $\Delta W$, then the associated first-order image audio source moves by a distance $2\Delta W$, as shown in FIG. 1. For any virtual walls that do not change location (even if they do get longer), there is no need to change the position of the image audio source associated with those virtual walls. This technique can be extended to include an arbitrary order of image sources.

After the update module 208 provides the positions 212 to the externalization module 202 (which may or may not have needed to be updated), the procedure 300 includes the externalization module 202 processing (310) the left and right audio signals using potentially updated filters that have been computed based on the respective positions of each virtual audio source and their associated image audio sources. The procedure 300 determines (312) if there is another time interval in which the loop will determine if any further updates are needed, and if so returns to the step 302. If not (e.g., due to termination or changing of the audio scene), then the procedure 300 optionally stores (314) the new layouts that have been learned in association with the particular audio scene that was in use. In some implementations, the stored layouts can be associated with a geographical location (e.g., using a geo-tagging with GPS coordinates of the wearable audio device), so that in a future execution in which the user is in proximity to the same geographical location, the stored layouts last used can be used as default initial layouts for a virtual room created for the same audio scene (or for a different audio scene in that location).

The audio processing system can be implemented using any of a variety of types of processing devices such as, for example, a processing device comprising a processor, a memory, and a communication module. The processor can take any suitable form, such as one or more microcontrollers, a circuit board comprising digital logic gates, or other digital and/or analog circuitry, a single processor, or multiple processor cores. The processor can be hard-wired or configured to execute instructions loaded as software or firmware. The memory may can include volatile memory, such as random access memory (RAM), and/or non-volatile memory such as read only memory (ROM), flash memory, a hard disk drive (HDD), a solid state drive (SSD), or other data storage media. Audio data and instructions for performing the procedures described herein, can be stored as software or firmware and may execute in an operating system, which may run on the processor. The communication module can be configured to enable wired or wireless signal communication between the audio processing system and components of the wearable audio device. The communication module be or include any module, device, or means capable of transmitting a wired or wireless signal, using technologies such as Wi-Fi (e.g., IEEE 802.11), Bluetooth, cellular, optical, magnetic, Ethernet, fiber optic, or other technologies.

The sensing system can include one or more sensors that are built into the wearable audio device, and may optionally include any number of additional sensors that are in proximity to the wearable audio device. For example, the user may wear earphones in which one of the earpieces includes an orientation sensor such as a gyroscope-based sensor or other angle-sensing sensor to provide angle information. Alternatively, or as a supplement, orientation information can be acquired by one or more sensors on an associated wearable device, such as eyewear worn by the user. The orientation sensor can be rigidly coupled one or both of the left or right earpieces so that the orientation of the user's head, and more specifically the orientation of the user's ears, can be determined. One of the earpieces can also be configured to include accelerometer-based sensors, camera-based sensors, or other position detecting sensors (e.g., compass/magnetometer) to provide position information. Alternatively, or as a supplement, position information can be acquired by one or more sensors in a device such as a smart phone that is in possession of the user. For example, signals from sensors on a smart phone, such as accelerometer/gyroscope/magnetometer signals, GPS signals, radio signals (e.g., Wi-Fi or Bluetooth signals), or signals based on images from one or more cameras (e.g., images processed using augmented reality software libraries) could be used to provide some of the position information. Position information can also be acquired by one or more sensors in a device in proximity to the wearable audio device. For example, one or more camera based sensors integrated into another device in the room could be used to provide the position information. The combined sensor output including position information and angle information can be transmitted (e.g., wirelessly transmitted) to a processing device, such as the user's phone or an audio system within the room, for rendering the left and right audio signals. Those rendered audio signals can then be transmitted (e.g., wirelessly transmitted) to the wearable audio device for driving acoustic drivers in the earpieces.

The term "head related transfer function" or acronym "HRTF" is intended to be used broadly herein to reflect any manner of calculating, determining, or approximating head related transfer functions. For example, a head related transfer function as referred to herein may be generated specific to each user, e.g., taking into account that user's unique physiology (e.g., size and shape of the head, ears, nasal cavity, oral cavity, etc.). Alternatively, a generalized head related transfer function may be generated that is applied to all users, or a plurality of generalized head related transfer functions may be generated that are applied to subsets of users (e.g., based on certain physiological characteristics that are at least loosely indicative of that user's unique head related transfer function, such as age, gender, head size, ear size, or other parameters). In one embodiment, certain aspects of the head related transfer function may be accurately determined, while other aspects are roughly approximated (e.g., accurately determines the inter-aural delays, but coarsely determines the magnitude response).

It should be understood that the image audio source management techniques described herein are applicable to a variety of types of wearable audio devices. The term "wearable audio device," as used in this document, is intended to include any device that fits around, on, in, or near an ear (including open-ear audio devices worn on the head or shoulders of a user) and that radiates acoustic energy into or towards the ear. Wearable audio devices can include, for example, headphones, earphones, earpieces, headsets, earbuds or sport headphones, helmets, hats, hoods, smart glasses, or clothing, and can be wired or wireless. A wearable audio device includes an acoustic driver to transduce audio signals to acoustic energy. The acoustic driver can be housed in an earpiece. A wearable audio device can include components for wirelessly receiving audio signals. In some examples, a wearable audio device can be an open-ear device that includes an acoustic driver to radiate acoustic energy towards the ear while leaving the ear open to its environment and surroundings.

While the disclosure has been described in connection with certain examples, it is to be understood that the disclosure is not to be limited to the disclosed examples but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. An audio system comprising:

a first earpiece comprising a first acoustic driver and circuitry that provides a first audio signal to the first acoustic driver;

a second earpiece comprising a second acoustic driver and circuitry that provides a second audio signal to the second acoustic driver;

a sensing system including at least one sensor, where the sensing system is configured to provide sensor output associated with a position of a wearable audio device; and a processing device configured to receive the sensor output and to determine updates to the first audio signal and the second audio signal based at least in part on information in the sensor output, where determining the updates comprises, for each of multiple time intervals:

determining an updated position of the wearable audio device, with respect to a coordinate system that has two or more dimensions, based at least in part on position information in the sensor output;

determining layouts of at least four virtual walls with respect to the coordinate system, where the layouts are determined such that the updated position is within a space defined by the virtual walls;

determining positions, with respect to the coordinate system, of at least four image audio sources associated with a virtual audio source, where a position of each image audio source is dependent on a layout of a corresponding one of the virtual walls and a position of the virtual audio source; and processing the first audio signal and the second audio signal using an update determined based at least in part on the respective positions of the virtual audio source and the image audio sources.

2. The audio system of claim 1, wherein the layouts are determined such that a layout of at least a first virtual wall is changed with respect to a layout of the first virtual wall in a previous time interval to enable the updated position to be within the space defined by the virtual walls.

3. The audio system of claim 2, wherein the layout of the first virtual wall is changed to increase the space defined by the virtual walls.

4. The audio system of claim 3, wherein the layout of the first virtual wall is changed based on the updated position being outside a previous space defined by the virtual walls before the layout of the first virtual wall was changed.

5. The audio system of claim 3, wherein the layout of the first virtual wall is changed based on a range between the updated position and a location on a physical wall measured by at least one range finding sensor in the sensing system.

6. The audio system of claim 2, wherein the layouts of all of the virtual walls are changed with respect to layouts of the virtual walls in the previous time interval.

7. The audio system of claim 6, wherein the layouts of all of the virtual walls are changed to rotate the space defined by the virtual walls to enable the updated position to be within the space defined by the virtual walls.

8. The audio system of claim 7, wherein the layouts of all of the virtual walls are changed based on a plurality of ranges between respective positions of the wearable audio device and respective locations on one or more physical walls measured by at least one range finding sensor in the sensing system.

9. The audio system of claim 2, wherein the previous time interval comprises an initial time interval in which the layouts of each of the four virtual wall is determined by a default configuration of a virtual room that is large enough that an initial position of the virtual audio source and an initial position of the wearable audio device are within a space defined by the virtual walls.

10. The audio system of claim 9, wherein the default configuration of the virtual room is large enough that initial positions of each of a plurality of virtual audio sources are within a space defined by the virtual walls.

11. The audio system of claim 1, wherein determining the updates further comprises, for each of the multiple time intervals, determining an updated orientation of the wearable audio device, with respect to the coordinate system, based at least in part on angle information in the sensor output.

12. The audio system of claim 11, wherein the update used to process the first audio signal and the second audio signal comprises updated filters applied to the first and second audio signals that incorporate acoustic diffraction effects represented by a head-related transfer function that is based at least in part on: the respective positions of the virtual audio source and the image audio sources, and the updated orientation.

13. The audio system of claim 11, wherein the angle information in the sensor output is provided by an orientation sensor that is rigidly coupled to at least one of the first or second earpiece.

14. The audio system of claim 1, wherein the layouts are determined such that a predetermined threshold distance around the updated position is within the space defined by the virtual walls.

15. The audio system of claim 1, wherein the coordinate system is a two-dimensional coordinate system, and the layouts of the virtual walls comprise line segments within the two-dimensional coordinate system.

16. The audio system of claim 1, wherein the coordinate system is a three-dimensional coordinate system, determining the layouts includes determining layouts of a virtual ceiling and a virtual floor with respect to the three-dimensional coordinate system, and the layouts of the virtual ceiling, the virtual floor, and the virtual walls comprise rectangles within the three-dimensional coordinate system.

17. The audio system of claim 16, wherein the layout of the virtual ceiling is determined such that the updated position is below the virtual ceiling, and the layout of the virtual floor is determined such that the updated position is above the virtual floor.

18. The audio system of claim 17, wherein determining the positions further comprises determining a position, with respect to the three-dimensional coordinate system, of: (1) at least a fifth image audio source associated with the virtual audio source, where a position of the fifth image audio source is dependent on the layout of the virtual ceiling and the position of the virtual audio source, and (2) at least a sixth image audio source associated with the virtual audio source, where a position of the fifth image audio source is dependent on the layout of the virtual floor and the position of the virtual audio source.

19. A method of providing a virtual acoustic environment, the method comprising:

providing a first audio signal to a first acoustic driver of a first earpiece;

providing a second audio signal to a second acoustic driver of a second earpiece;

providing sensor output from a sensing system that includes at least one sensor, where the sensor output is associated with a position of a wearable audio device;

receiving the sensor output at a processing device; and determining, using the processing device, updates to the first audio signal and the second audio signal based at least in part on information in the sensor output, where determining the updates comprises, for each of multiple time intervals:

determining an updated position of the wearable audio device, with respect to a coordinate system that has two or more dimensions, based at least in part on position information in the sensor output;

determining layouts of at least four virtual walls with respect to the coordinate system, where the layouts are determined such that the updated position is within a space defined by the virtual walls;

determining positions, with respect to the coordinate system, of at least four image audio sources associated with a virtual audio source, where a position of each image audio source is dependent on a layout of a corresponding one of the virtual walls and a position of the virtual audio source; and processing the first audio signal and the second audio signal using an update determined based at least in part on the respective positions of the virtual audio source and the image audio sources.

20. The method of claim 19, wherein the layouts are determined such that a layout of at least a first virtual wall is changed with respect to a layout of the first virtual wall in a previous time interval to enable the updated position to be within the space defined by the virtual walls.

21. The method of claim 20, wherein the layout of the first virtual wall is changed to increase the space defined by the virtual walls.

22. The method of claim 21, wherein the layout of the first virtual wall is changed based on the updated position being outside a previous space defined by the virtual walls before the layout of the first virtual wall was changed.

23. The method of claim 21, wherein the layout of the first virtual wall is changed based on a range between the updated position and a location on a physical wall measured by at least one range finding sensor in the sensing system.

24. The method of claim 20, wherein the layouts of all of the virtual walls are changed with respect to layouts of the virtual walls in the previous time interval.

25. The method of claim 24, wherein the layouts of all of the virtual walls are changed to rotate the space defined by the virtual walls to enable the updated position to be within the space defined by the virtual walls.

26. The method of claim 20, wherein the previous time interval comprises an initial time interval in which the layouts of each of the four virtual wall is determined by a default configuration of a virtual room that is large enough that an initial position of the virtual audio source and an initial position of the wearable audio device are within a space defined by the virtual walls.

27. The method of claim 19, wherein determining the updates further comprises, for each of the multiple time intervals, determining an updated orientation of the wearable audio device, with respect to the coordinate system, based at least in part on angle information in the sensor output.

28. The method of claim 27, wherein the update used to process the first audio signal and the second audio signal comprises updated filters applied to the first and second audio signals that incorporate acoustic diffraction effects represented by a head-related transfer function that is based at least in part on: the respective positions of the virtual audio source and the image audio sources, and the updated orientation.

29. The method of claim 19, wherein the layouts are determined such that a predetermined threshold distance around the updated position is within the space defined by the virtual walls.

* * * * *